US012514361B2

(12) United States Patent
Frost

(10) Patent No.: US 12,514,361 B2
(45) Date of Patent: Jan. 6, 2026

(54) WEARABLE APPARATUS TO ASSIST IN CARRYING OBJECTS

(71) Applicant: Dane C Frost, Portland, OR (US)

(72) Inventor: Dane C Frost, Portland, OR (US)

( * ) Notice: Subject to any disclaimer, the term of this patent is extended or adjusted under 35 U.S.C. 154(b) by 115 days.

(21) Appl. No.: 18/351,997

(22) Filed: Jul. 13, 2023

(65) Prior Publication Data

US 2024/0138550 A1 May 2, 2024

Related U.S. Application Data

(60) Provisional application No. 63/420,094, filed on Oct. 28, 2022.

(51) Int. Cl.
*A45F 5/02* (2006.01)

(52) U.S. Cl.
CPC ..... *A45F 5/021* (2013.01)

(58) Field of Classification Search
CPC ..... A45F 5/021; A47B 23/002; F16M 13/04
USPC ..... 224/270; 108/43
See application file for complete search history.

(56) References Cited

U.S. PATENT DOCUMENTS 4,319,704 A * 3/1982 Rosen ..... A45F 5/02 224/907
5,511,707 A * 4/1996 Reichert ..... A45F 5/00 224/678
6,443,342 B1 * 9/2002 Kahn ..... B25H 3/006 224/904
D467,068 S 12/2002 Lewis et al.
10,076,179 B2 * 9/2018 Asay ..... A45F 5/021
D918,574 S 5/2021 Kumria
D930,356 S 9/2021 Eremita
11,284,731 B2 3/2022 Quinn
11,304,503 B2 4/2022 Blumenthal et al.
11,419,406 B1 * 8/2022 Ricard ..... A47G 23/0225
2005/0161479 A1 * 7/2005 Licsko ..... A45F 3/14 224/270
2007/0226958 A1 * 10/2007 Clifton ..... A45F 5/02 24/3.12
2009/0179055 A1 * 7/2009 Estrellado ..... A45F 5/02 224/269
2017/0035187 A1 2/2017 Chapman
2020/0054117 A1 2/2020 Alley
2021/0378331 A1 12/2021 Kassab et al.
2022/0265033 A1 8/2022 Kumria
2022/0323849 A1 10/2022 Hughes

OTHER PUBLICATIONS

"BeltShelf," downloaded from https://thepackagehandler.com/ols/all?sortOption=descend_by_created_at (document dated 2021, downloaded before Oct. 28, 2022).
"Vestil," downloaded from https://www.vestil.com/product.php?FID=351 (document not dated, downloaded before Oct. 28, 2022).

* cited by examiner

*Primary Examiner* — Adam J Waggenspack
(74) *Attorney, Agent, or Firm* — Small Business Legal Clinic; Cera Oh; Joseph Mogavero

(57) ABSTRACT

An apparatus that assists in carrying objects. The apparatus comprises a lower portion comprising a garment attachment and an upper portion comprising a protrusion.

16 Claims, 6 Drawing Sheets

Select building material and method
1005

Create a protrusion comprising a concave section, a knob, and a slanted, textured surface
1010

Create a set of one or more arms
1015

Creating an attachment device
1020

End

FIGURE 5

Attach garment to user body
1025

Place garment between innermost and outermost arms of apparatus such that protrusion is located above the one or more arms
1030

Place object on the protrusion of the wearable apparatus
1035

Transport object to destination
1040

End

FIGURE 6

WEARABLE APPARATUS TO ASSIST IN CARRYING OBJECTS

FIELD OF INVENTION

This apparatus relates to a wearable device that assists in carrying objects. Specifically, heavy objects that can be strenuous to carry.

BACKGROUND

There are a variety of existing devices that can be used to assist people in carrying objects. The features of these devices differ based on the specific intended purpose. These devices may be tailored to accommodate different types of objects such as large objects, heavy objects, or fragile objects. These devices may also be designed to accommodate other needs such as size, comfortability, and ease-of-use. Additionally, these devices may be designed with the landscape or terrain the user must traverse as well as the distance the user must travel while using the device.

SUMMARY

Embodiments of the present disclosure include an apparatus for aiding in carrying objects comprising a lower portion comprising a garment attachment and an upper portion comprising a protrusion.

The above summary is not intended to describe each illustrated embodiment or every implementation of the present disclosure.

BRIEF DESCRIPTION OF THE DRAWINGS

The drawings included in the present disclosure are incorporated into, and form part of, the specification. They illustrate embodiments of the present disclosure and, along with the description, serve to explain the principles of the disclosure. The drawings are only illustrative of certain embodiments and do not limit the disclosure.

FIG. 5 illustrates an example of a flowchart of a method of manufacture for an apparatus that assists in carrying objects in accordance with embodiments of the present disclosure.

FIG. 6 illustrates an example of a flowchart of a method of using an apparatus that assists in carrying objects in accordance with embodiments of the present disclosure.

Figure 1:
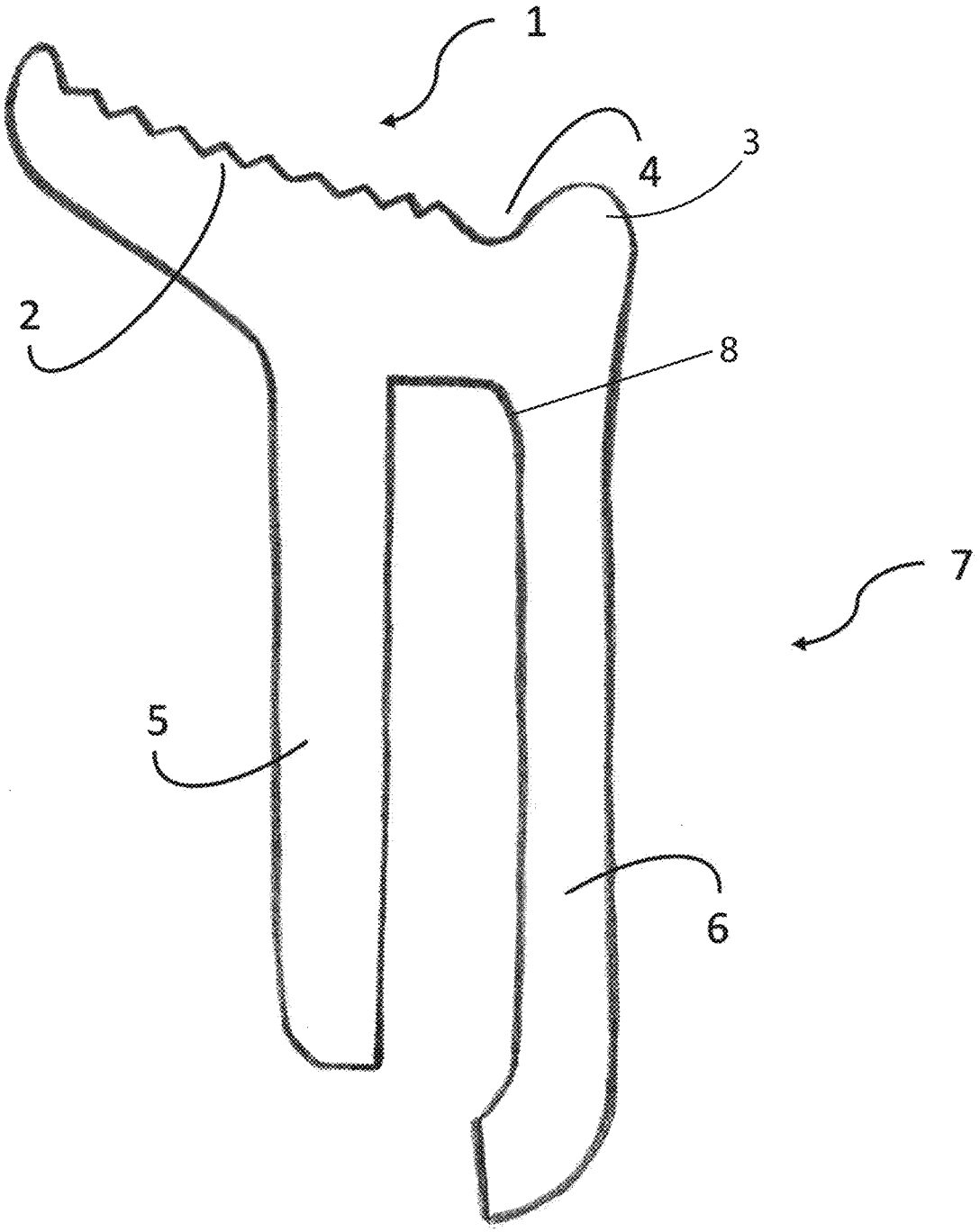
FIG. 1 is a side view of an example of an apparatus used for carrying objects according to embodiments of the present disclosure.
Figure 2:
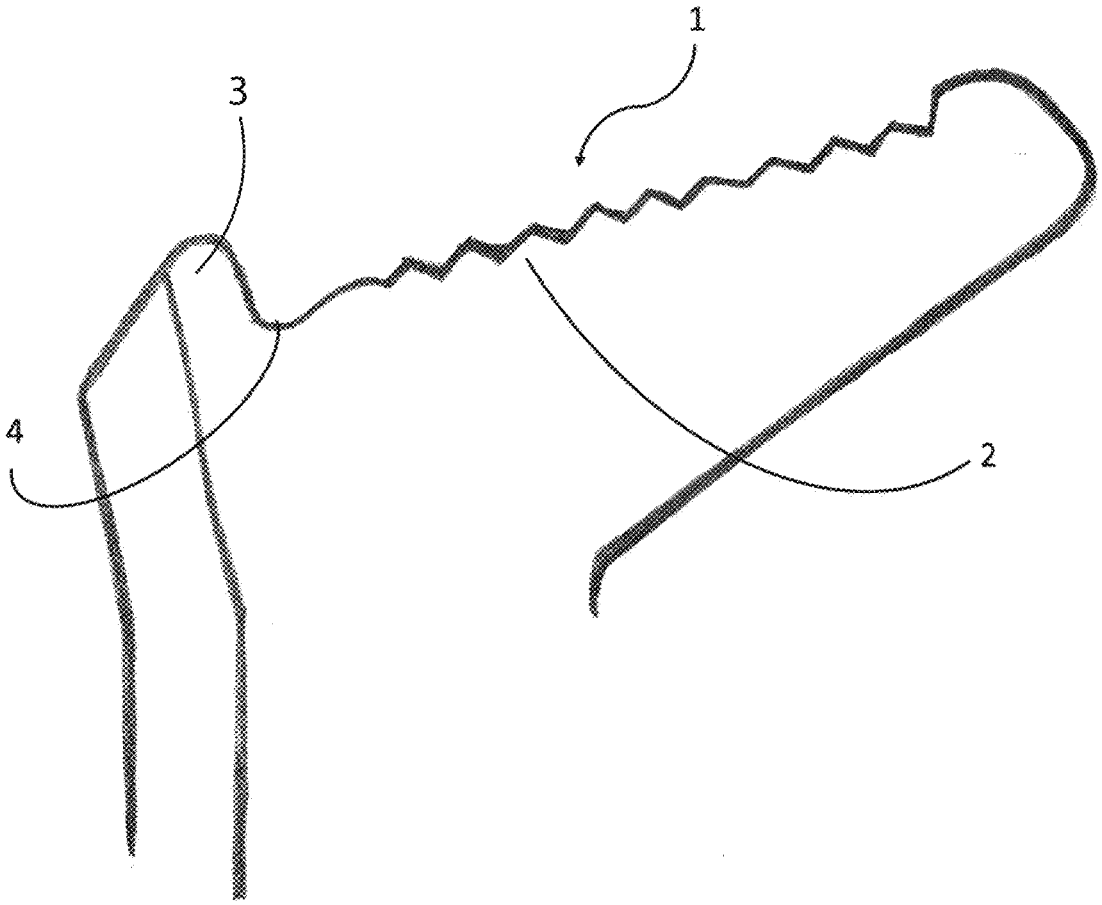
FIG. 2 is a side angled view of an example of the protrusion and its various features.
Figure 3:
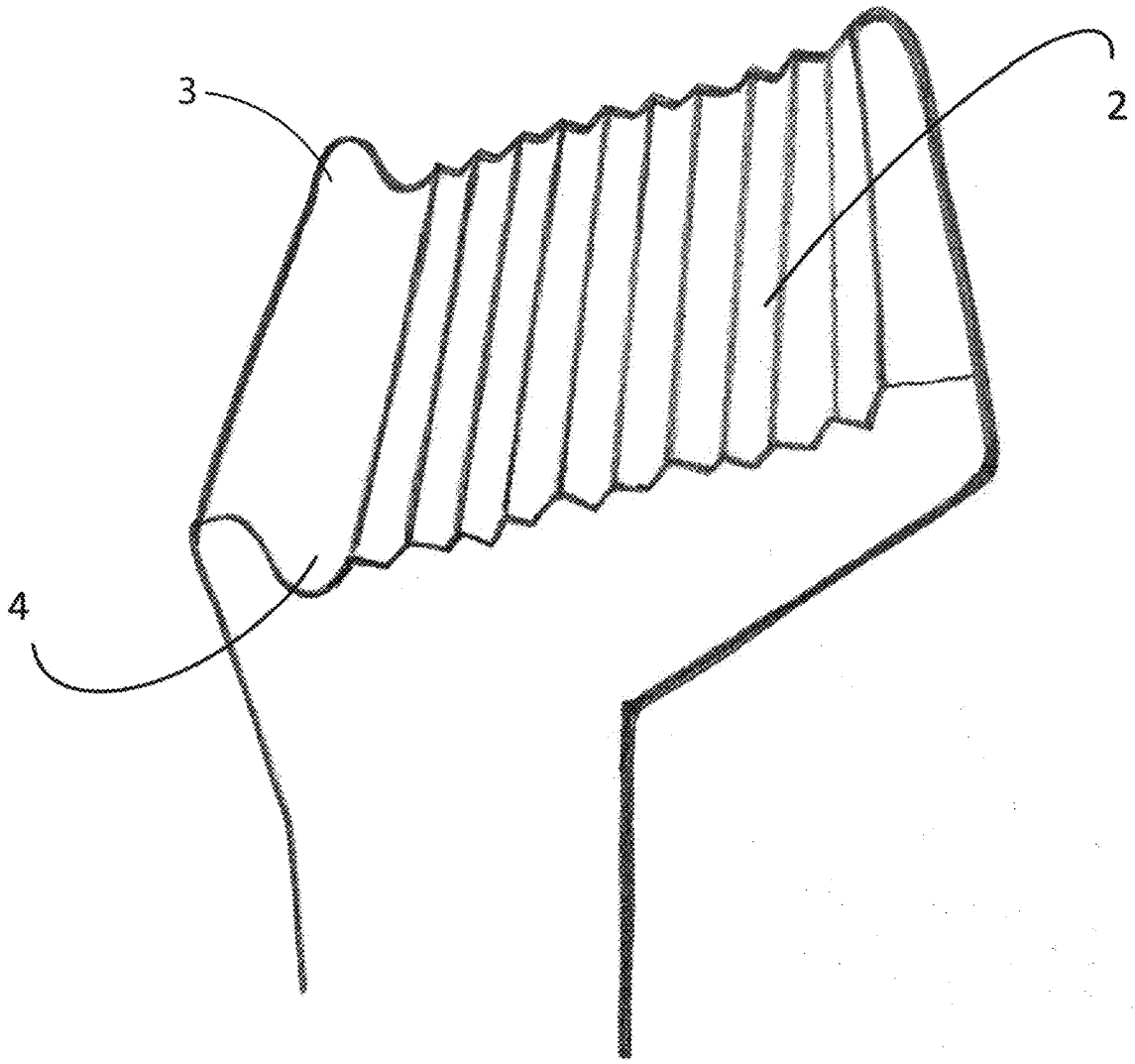
FIG. 3 illustrates an angled view of the top of the protrusion of the apparatus.

While the embodiments described herein are amenable to various modifications and alternative forms, specifics thereof have been shown by way of example in the drawings and will be described in detail. It should be understood, however, that the particular embodiments described are not to be taken in a limiting sense. On the contrary, the intention is to cover all modifications, equivalents, and alternatives falling within the spirit and scope of the invention.

DETAILED DESCRIPTION

Embodiments of the present disclosure seek to allow the user to carry heavy or large objects with greater ease than they would otherwise be able to without said device. Many existing devices used for the purpose of carrying or transporting objects are uncomfortable to wear, cumbersome to attach and remove, heavy, or large and therefore difficult to store. Many existing devices restrict the user's movement and can get in the way of the user performing other tasks. Some of these devices attach by wrapping around the user's waist.

While the present disclosure is not necessarily limited to such applications, various aspects of the disclosure may be appreciated through a discussion of various examples using this context.

In some embodiments, the apparatus can be easily attached and removed from the user's garment belt. In some embodiments, the user attaches the device to a garment belt by positioning their garment belt between the outermost arm 5 and the innermost arm 6. The outermost arm 5 and the innermost arm 6 in this embodiment may have a distance between them around 1/16th inch and 2 inches. In this orientation, the outermost surface of the innermost arm is positioned against the user's hip. In some embodiments, when the device is in use and an object is positioned on the apparatus, the user may be able to use just one arm to carry the device.

In other embodiments, the device may be attached to other straps or articles of clothing, such as a direct application to a pants waist.

Embodiments of the present disclosure include features to stabilize an object resting on the protrusion 1 of the apparatus; these features may include concave section 4, a knob 3, and protrusion 1. In some embodiments the surface of the apparatus may be slanted so as to keep the object from slipping off of the device away from the user's body. In some embodiments, the surface of the apparatus may be textured. In some embodiments the texture of the surface of the device may be ridged with teeth-like wedges 2 that function as a high coefficient of friction surface to avoid slippage of the object being carried. In some embodiments, the teeth-like wedges 2 may have a slightly different surface configuration for providing proper grip and friction. For example, a cross-hatched surface, an adhesive-enhanced surface, a tread-like surface with various patterns and ridge depths, etc. In yet other embodiments, the surface with the teeth-like wedges 2 may be detachable, and a set of similar, yet distinct, gripping surfaces may be attached in its place. In this way, the teeth-like wedges 2 may be configured in a way that is optimal for whatever task or burden (e.g., package) the user is facing. In yet a further embodiment, the surface of the apparatus may be ferromagnetic to provide a degree of magnetic stabilizing force for metal objects and/or a metal or magnetic attachment to an object to be carried using the apparatus.

The apparatus may include a knob 3 located at the innermost point of the surface of the protrusion to assist in keeping an object from falling off the edge of the surface of the protrusion of the apparatus. The knob 3 is a small protrusion at the edge of the surface of the protrusion 1. The knob 3 stabilizes the carried object on the protrusion by providing another point of contact between the apparatus and the object being carried. The knob 3 may be made of the same material as the device or a different material (e.g., a titanium alloy, stainless steel, plastic composite, etc.). The knob 3 may be a variety of shapes. For example, the knob may be rounded, rectangular, triangular, or in the shape of a hook.

Additionally, the apparatus has a concave section 4 at the base of the surface closest to the user as an additional feature to keep the carried object secure on the device. This concave section 4 aids in keeping the carried object secure by catching the carried object if it slides toward the user. The innermost arm 6 of the apparatus is longer than the outermost arm 5 to maximize comfort and keep the device in the desired position.

Embodiments of the present disclosure may be made, if desired, using 3D printing. In other embodiments, the device may be made via injection molding. In yet other embodiments, the apparatus may be made via metal casting, metal forging, or metal stamping.

Embodiments of the present disclosure may be made of a polymer or non-polymer material. In some embodiments the device may be made of a material suitable for injection molding. In other embodiments, the device may be made of metal. In other embodiments, the apparatus may be made of plastics. In some embodiments the apparatus may be made of material suitable for 3D printing such as acrylonitrile butadiene styrene, polylactic acid, polyethylene terephthalate glycol, nylon, thermoplastic polyurethane, or other resins or composites. In yet other embodiments, the device may be made of stiff nylon webbing.

When in use, embodiments of the present disclosure removes some strain on the user's back from carrying heavy objects by redistributing some of the weight of the package away from the user's back and arms and towards the user's hips and legs.

In some embodiments, the garment attachment of the apparatus may include a notch in the one or more arms that form around the user's garment belt or other appropriate strap or garment. In some embodiments the device may include mechanical means to keep the device in the desired location by allowing the arms of the device to adjust and tighten around the user's belt. These mechanical means may include a clamping device that clamps the belt between the arms of the device and includes means for keeping the arms pressed together with the belt between them. In other embodiments, a carabiner style clip may be implemented in place of, or in addition to, a clamp. In yet further embodiments, such clip and/or clamp may include a breakaway mechanism to prevent user injury when a dangerously heavy object is applied to the apparatus.

A protrusion 1 connects two spaced arms 7 as shown in FIG. 1. The innermost arm 6 is longer than the outermost arm 5. The length of the opening between the arms is equal to or greater than the height of a belt. The width between the legs may be equal to or greater than the width of a belt. In some embodiments, the width may be adjustable via a hinge (not pictured) near concave section 4; in other embodiments, the apparatus itself may include a screw clamp mechanism, much like a vise, to adjust the width.

In some embodiments, the protrusion 1 may be slanted in that it is continuously sloping at an angle greater than ninety degrees in relation to the innermost arm 6. The protrusion also has teeth-like wedges 2. There is a knob 3 located at the innermost point of the protrusion 1. In some embodiments there may be a concave indentation 4 at the innermost section of the protrusion 1. In yet other embodiments, a series of knobs 3 may line the innermost edge of protrusion 1.

Figure 4:
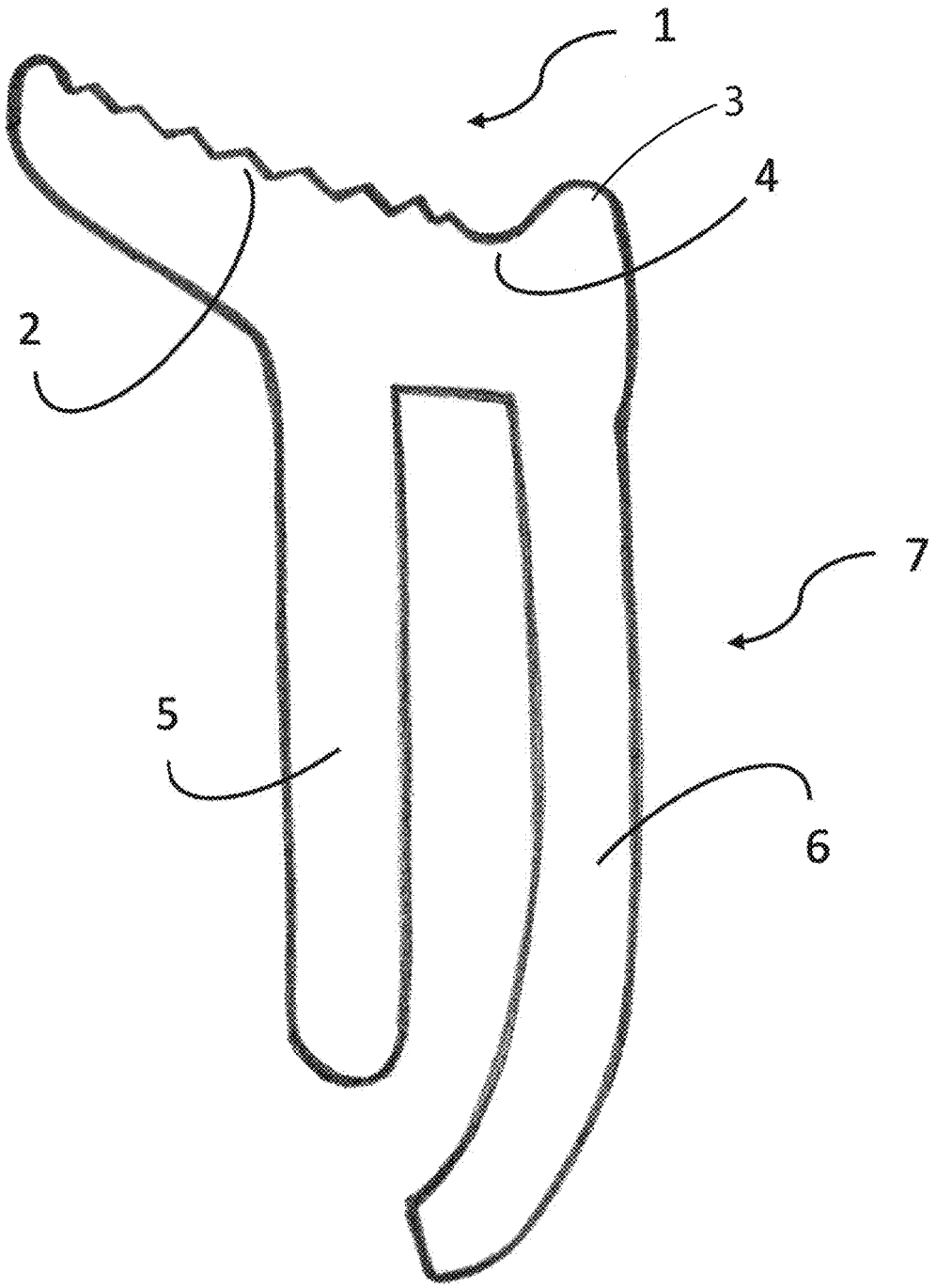
FIG. 4 is an example of an embodiment with a curved innermost arm.

In some embodiments, as in FIG. 4, the innermost arm 6 may be curved to contour to the user's hip thereby increasing comfortability. In some embodiments, the innermost arm may be made of a series of angles creating a wedge shape 8. In some embodiments, the innermost arm 6 may be custom-fit to an individual user's hip dimensions in the manufacturing process.

In some embodiments, the innermost arm 6 may be cushioned on its outermost surface to provide increased comfort to the user. The innermost arm 6 may be cushioned with foam, fabric, leather, rubber, neoprene, or any type of soft material suitable for this purpose.

What is claimed is:

1. An apparatus to assist in carrying heavy objects, the apparatus comprising:
- a lower portion comprising a garment attachment; and
- an upper portion comprising:
  - a slanted protrusion, wherein an apex point is furthest from a user's body and a bottom point is closest to the user's body;
  - a rounded concave section on a surface of the slanted protrusion, opposite to the side comprising the garment attachment of the lower portion;
  - a knob located at the bottom point; and
  - wherein the surface of the slanted protrusion is rigid and textured the concave section being located between the textured surface and the knob.

2. The apparatus of claim 1, wherein the garment attachment comprises one or more arms.

3. The apparatus of claim 2, wherein the one or more arms further comprise:
- an outermost arm;
- and an innermost arm, the innermost arm extending farther from the slanted protrusion than the outermost arm.

4. The apparatus of claim 2, wherein the one or more arms are connected by the slanted protrusion.

5. The apparatus of claim 2, wherein the one or more arms are adapted to removably attach to garments.

6. The apparatus of claim 1, wherein the slanted protrusion extends beyond the width of the lower portion.

7. The apparatus of claim 3, wherein the slanted protrusion is continuously sloping at an angle greater than ninety degrees from the innermost arm, said slanted protrusion extending from the innermost arm and beyond the outermost arm.

8. The apparatus of claim 2, wherein the one or more arms are capable of attaching to a garment belt.

9. The apparatus of claim 2, wherein the one or more arms are of differing lengths.

10. The apparatus of claim 2, wherein the width of the upper portion, extending from the innermost point to the outermost point, is wider than the width of the lower portion.

11. The apparatus of claim 10, wherein the upper portion is between 2 inches and 5 inches wide.

12. The apparatus of claim 2, wherein the space between the one or more arms is between 1/16th inch and 2 inches.

13. The apparatus of claim 12, wherein the space between the one or more arms is adjustable.

14. The apparatus of claim 3, wherein the innermost arm is a wedge shape comprising a series of angles.

15. A method of manufacturing a wearable apparatus to assist in carrying objects, the method comprising:
- creating a slanted protrusion comprising a concave section, a knob, and a slanted, textured surface capable of attaching to a set of one or more arms the concave section being located between the textured surface and the knob;
- creating the set of one or more arms; creating an attachment device, capable of removably attaching the apparatus to garments;
- and combining the slanted protrusion, the set of one or more arms, and the attachment device to create the wearable apparatus.

16. A method for using the wearable apparatus to assist in carrying objects of claim 1, the method comprising:

providing the wearable apparatus to assist in carrying objects of claim 1;

placing a garment between an innermost arm and an outermost arm of the wearable apparatus, wherein the wearable apparatus comprises one or more spaced arms and a protrusion such that the protrusion of the wearable apparatus is located above the innermost and outermost arms; and placing an object on the protrusion of the wearable apparatus.

* * * * *